US006398020B1

(12) United States Patent
Smith

(10) Patent No.: US 6,398,020 B1
(45) Date of Patent: Jun. 4, 2002

(54) CONTAINER FOR PHOTOGRAPHS OR THE LIKE

(76) Inventor: Scott D. Smith, 1223 White Oak Dr., Hernando, MS (US) 38632

( * ) Notice: Subject to any disclaimer, the term of this patent is extended or adjusted under 35 U.S.C. 154(b) by 0 days.

(21) Appl. No.: 09/716,254

(22) Filed: Nov. 21, 2000

(51) Int. Cl.[7] ..... B65D 75/00
(52) U.S. Cl. ..... 206/232; 206/455; 229/72
(58) Field of Search ..... 206/232, 425, 206/449, 454, 455; 229/67.1, 67.4, 68.1, 68.2, 70–72, 76, 84; 383/106

(56) References Cited

U.S. PATENT DOCUMENTS

| | | | | | |
|---|---|---|---|---|---|
| 1,181,757 | A | * | 5/1916 | Forgue | 229/84 |
| 2,499,528 | A | * | 3/1950 | Reitzes | 383/106 |
| 3,383,028 | A | * | 5/1968 | Brander | 229/84 |
| 3,838,808 | A | * | 10/1974 | Schroeder | 229/72 |
| 4,047,661 | A | | 9/1977 | Klein | |
| 4,057,140 | A | | 11/1977 | Hutzel | |
| 4,629,070 | A | | 12/1986 | Roberg | |
| 4,653,639 | A | * | 3/1987 | Traynor | 229/72 |
| 4,836,382 | A | | 6/1989 | Schreiber | |
| 5,060,847 | A | | 10/1991 | Angus | |
| 5,103,972 | A | | 4/1992 | Ackeret | |
| 5,316,208 | A | * | 5/1994 | Petkovsek | 229/72 |
| 5,398,866 | A | * | 3/1995 | Bluemle | 229/68.1 |
| 5,431,449 | A | | 7/1995 | Arimoto et al. | |

* cited by examiner

*Primary Examiner*—Jim Foster
(74) *Attorney, Agent, or Firm*—Nixon & Vanderhye; Frank P. Presta

(57) ABSTRACT

A reclosable container for articles such as film cartridges, photographs, negatives or the like, comprising a rear panel, a pair of front flaps foldably connected to the sides of the rear panel and extending laterally inwardly over the rear panel in spaced relation thereto, a front panel foldably connected to the bottom of the rear panel and extending upwardly over the front flaps, and a cover panel foldably connected to the top of the rear panel and extending in a closed position downwardly over the front panel. The rear panel, front flaps and front panel define a first compartment for film cartridges, photographs or the like. The front flaps and the front panel define between the overlapped portions thereof a second compartment in front of the first compartment for negatives or the like. The front panel is releasably connected to the front flaps, and the cover panel is releasably connected to the front panel when in the closed position.

10 Claims, 3 Drawing Sheets

CONTAINER FOR PHOTOGRAPHS OR THE LIKE

BACKGROUND OF THE INVENTION

The present invention relates to a reclosable container for articles such as photographs and the like and, more particularly, to such a container that provides separate compartments for articles such as film cartridges, photographs and negatives.

In the case of photographic products, particularly developed photographs for distribution to consumers, the traditional packaging is a flimsy paper envelope-type package which does not adequately protect the photographic products that are susceptible to damage by bending, scratching or tearing. Such envelope-type packages usually include the developed photographs and the negatives in one compartment. Also, such paper packages do not prevent the contents from deteriorating from exposure to moisture, and paper has an acid content that will damage photographic products stored therein.

The negatives are misplaced in many instances after the photographs are reviewed and stored in albums or the like, or the negatives are stored separately from the photographs and thus are difficult to locate or identify when additional prints are desired.

Accordingly, a need exists for a simple, strong, reusable package for dispensing and storing articles such as film cartridges, photographs and/or negatives in separate compartments in a safe condition. The new and improved container of the present invention meets this need.

SUMMARY OF THE INVENTION

The reclosable container of the present invention is formed of any suitable material, preferably a clear plastic, flexible and resilient material, and generally comprises a rear panel of a size greater than the size of standard developed photographs. Foldably connected to the rear panel are a top panel, two side panels and a bottom panel, all of which are of substantially the same width that is large enough to accommodate film cartridges, a set of developed photographs and/or the negatives for same. A front panel is foldably connected to the outer edge of the bottom panel, and a cover panel is foldably connected to the outer edge of the top panel. Each side panel has a front flap foldably connected to the outer edge thereof. Also, a bottom tab is foldably connected to the lower edge of each side panel and is approximately the same width as the side panel.

In the assembled container, the top panel, side panels and bottom panel extend forwardly in generally perpendicular relation to the rear panel. The bottom tabs extend inwardly over the bottom panel in substantially parallel relation thereto. The front flaps extend laterally inwardly in spaced and generally parallel relation to the rear panel, the front panel extends upwardly over the front flaps in spaced and generally parallel relation to the rear panel, and the cover panel extends downwardly over the front panel in spaced and generally parallel relation to the rear panel.

The assembled panels define a first or rear compartment for photographs, film cartridges or the like. The assembled front flaps and front panel define therebetween a narrow second or front compartment for negatives or the like. To maintain the container in assembled condition, the front panel has locking tabs that are removably received within slits at the fold lines between the front flaps and side panels. The cover panel has a locking tab that is removably received within a slit in the front panel.

The container of the present invention, therefore, provides separate, safe compartments for film cartridges, photographs and/or negatives, is simple in construction, easy to assemble and easy to open and close. The negatives are retained in the second or front compartment by the frictional engagement between the end portions of the negatives and the adjacent overlapped surfaces of the front flaps and front panel.

DESCRIPTION OF THE PREFERRED EMBODIMENTS

Figure 1:
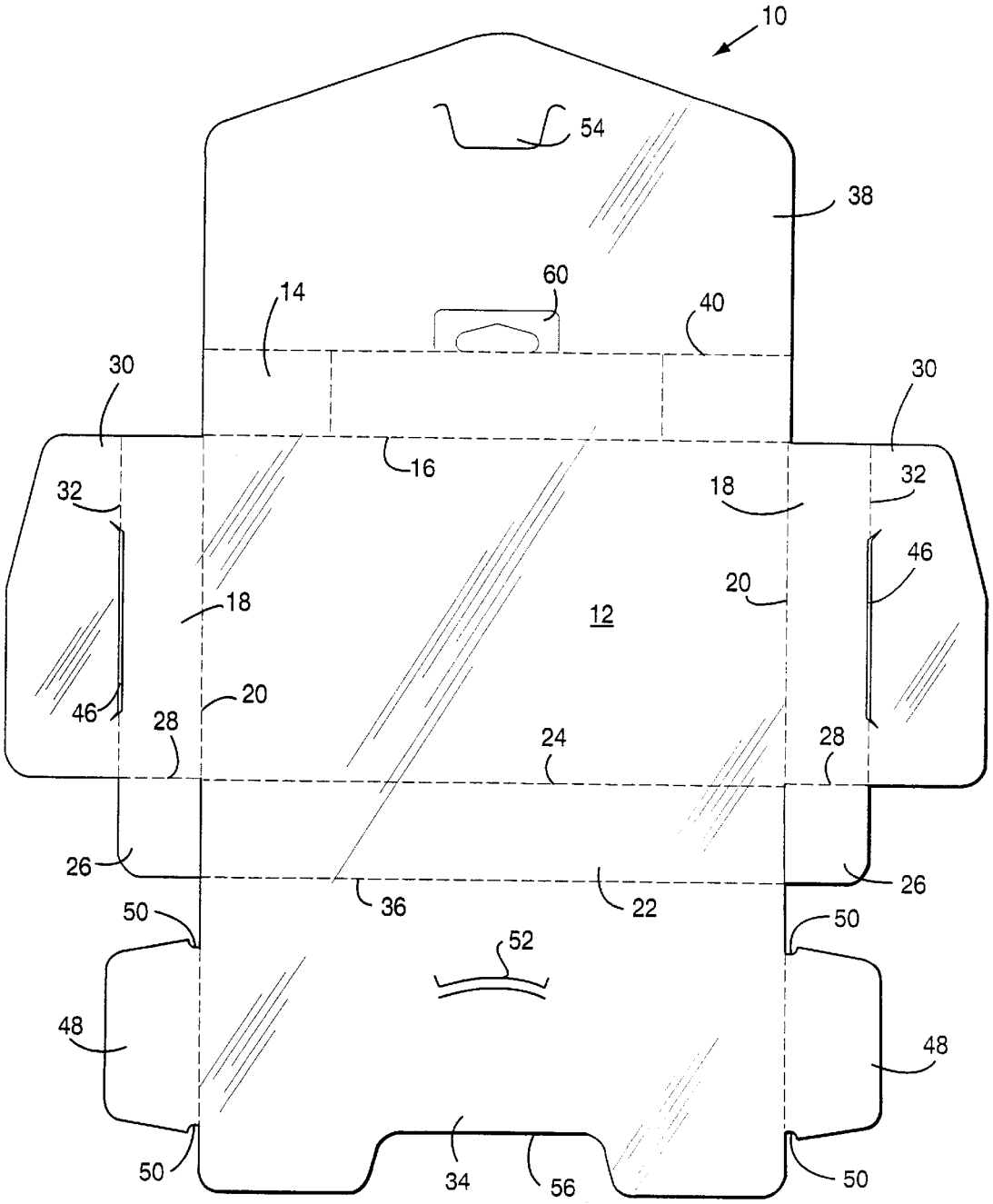
FIG. 1 is a plan view of the blank for the container of the present invention.

FIG. 1 illustrates a blank 10 for the reclosable container of the present invention. Preferably, the blank 10 is of unitary construction and is formed of any suitable flexible and resilient, clear plastic material. Within the scope of the present invention, the blank 10 may be formed of any suitable material.

The blank 10 comprises a rear panel 12 that is of a size greater than the size of standard developed photographs or other articles intended to be placed in the container to be formed from the blank. A top panel 14 is connected to the rear panel 12 by a first fold line 16. Side panels 18 are connected to the sides of the rear panel 12 by second fold lines 20, and a bottom panel 22 is connected to the bottom of the rear panel 12 by a third fold line 24. A pair of bottom tabs 26 are connected to the bottom of the side panels 18 by fourth fold lines 28.

A pair of front flaps 30 are connected to the side panels 18 by fifth fold lines 32. A front panel 34 is connected to the bottom panel 22 by a sixth fold line 36, and a cover panel 38 is connected to the top panel 14 by a seventh fold line 40.

The fold lines 32 have first slits 46 therein that are adapted to be releasably engaged by laterally outwardly extending first locking tabs 48 on the front panel 34. The first locking tabs 48 preferably taper outwardly and are recessed at 50 near their inner ends to enable them to be snap-fitted in the first slits 46.

The front panel 34 has a second slit 52 in the mid-portion thereof that is adapted to be engaged by a second locking tab 54 on the cover panel 38 when it is moved to a closed position as hereinafter described.

Figure 2:
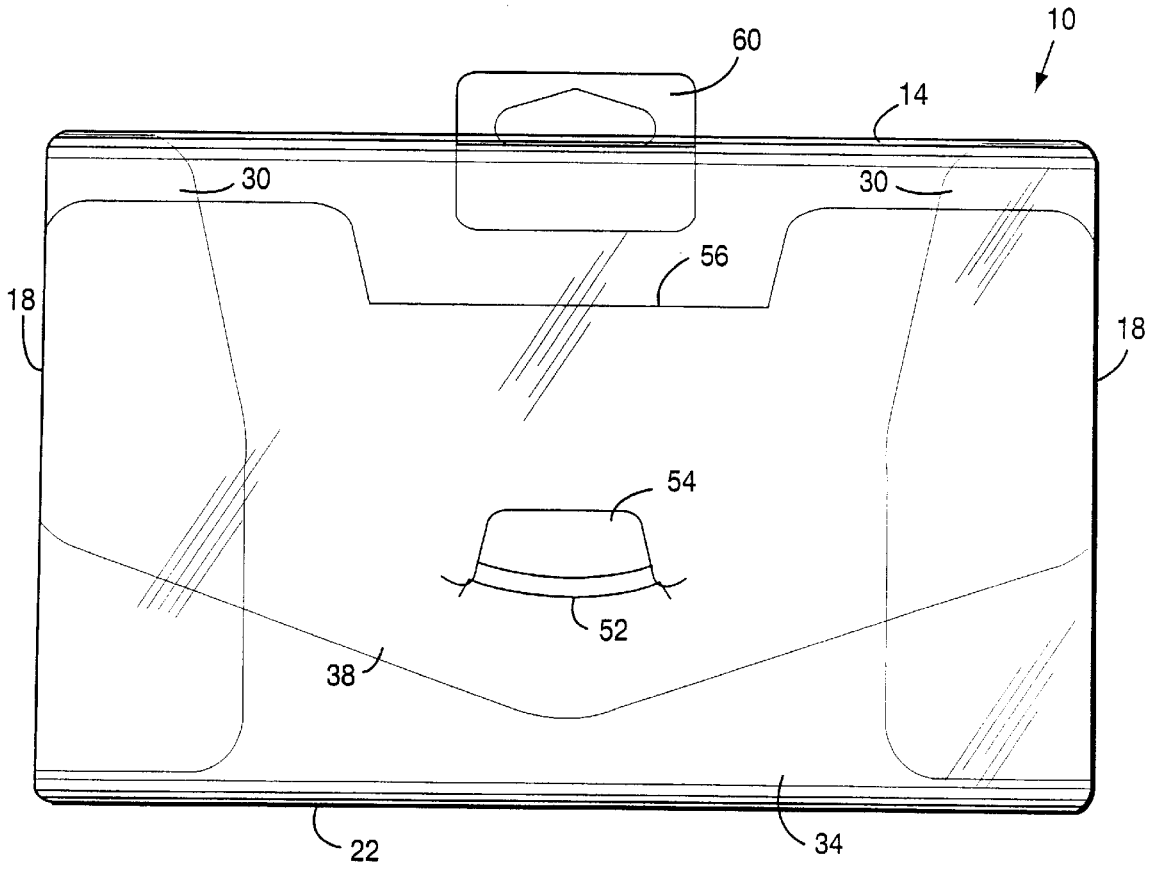
FIG. 2 is a front elevational view of the container of the present invention in assembled form with the cover panel in a closed position.
Figure 3:
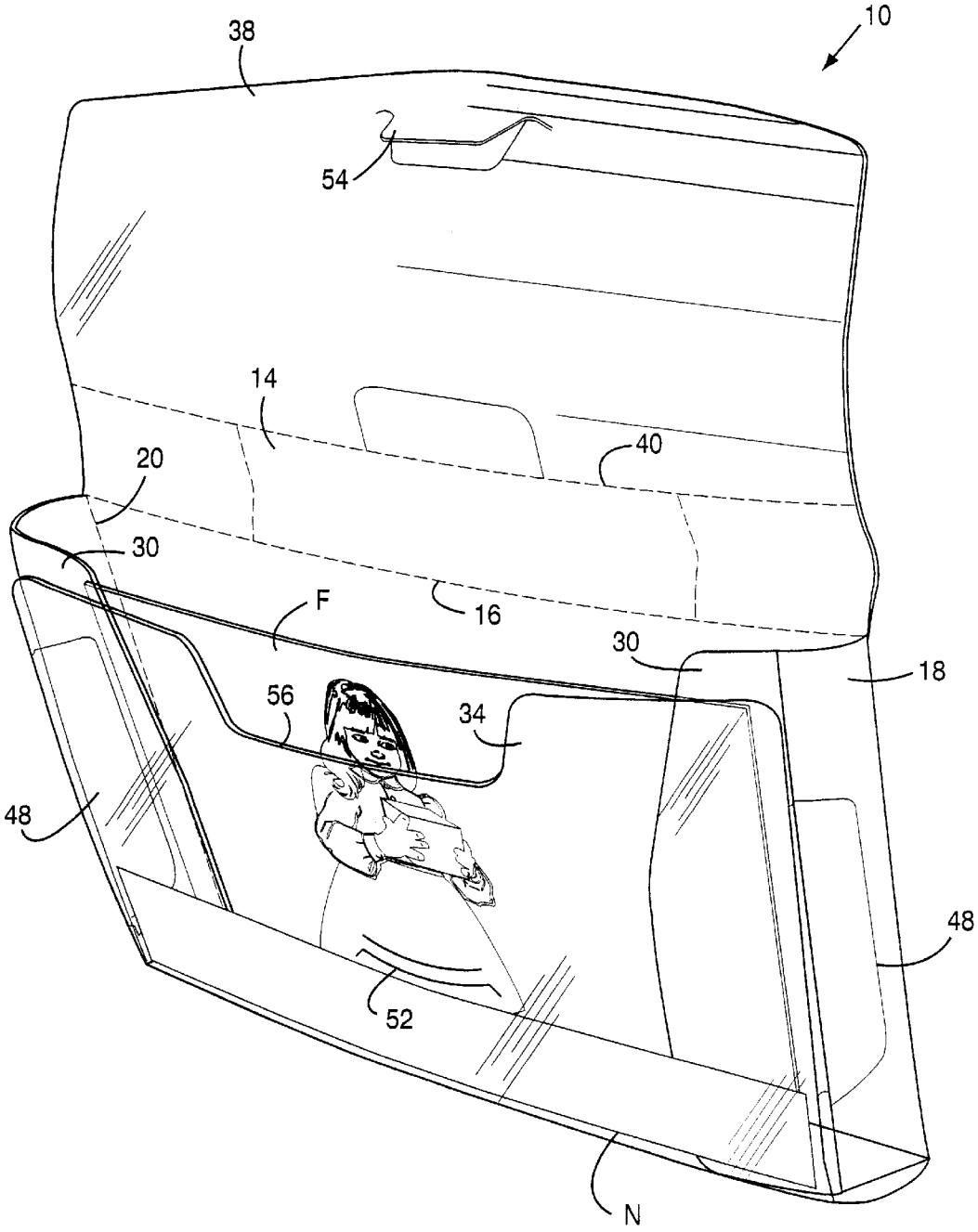
FIG. 3 is a perspective view of the container of the present invention in assembled form with film and negatives therein, and with the cover panel in an open position.

FIGS. 2 and 3 illustrate the blank 10 in assembled position to form a container for articles such as film cartridges, photographs, negatives and the like. In the assembly of the container, the side panels 18 are first folded inwardly into substantially perpendicular relation to the rear panel 12 and the front flaps are folded inwardly into substantially perpendicular relation to the side panels such that the front flaps are in substantially parallel relation to the rear panel 12. The bottom tabs 26 on the side panels 18 are then folded inwardly into substantially perpendicular relation to the side panels.

Thereafter, the bottom panel 22 is folded inwardly into substantially perpendicular relation to the rear panel 12 and the front panel 34 is folded upwardly into substantially perpendicular relation to the bottom panel 22 such that it is generally parallel to the rear panel 12. In order to connect the front panel 34 to the front flaps 30, the first locking tabs 48 are folded inwardly and inserted into the first slits 46 in the fold lines 32 so as to be in releasable locking engagement therewith.

The rear panel 12, top panel 14, side panels 18, bottom panel 22, front flaps 30 and front panel 34 define a first compartment $C_1$ (FIG. 3) for holding articles such as film cartridges, photographs F or the like. The front flaps 30 and front panel 34 define in the overlapped portions thereof a narrow second compartment $C_2$ disposed in front of the first compartment $C_1$ for holding flat articles such as negatives N or the like as shown in FIG. 3.

To close the container 10, the top panel 14 is folded downwardly into substantially perpendicular relation with the rear panel 12 and the cover panel 38 is folded downwardly into substantially perpendicular relation with the top panel 14 such that it extends in substantially parallel relation to the rear panel 12. The second locking tab 54 of the cover panel 38 is inserted into the second slit 52 in the front panel 34 for releasable locking engagement therewith when the cover panel is moved into the closed position over the front panel 34, as shown in FIG. 2. By releasing the second locking tab 54 from the second slit 52, the cover panel 38 can again be moved to the open position of FIG. 3 for access to the contents of the container.

The front panel 34 is recessed at the mid-portion 56 thereof to expose the negatives N or the like in the second compartment $C_2$ to enable them to be easily gripped.

The top panel 14, rear panel 12 or cover panel 38 may be provided with a handle or grip portion 60 of any suitable construction secured thereto or formed integrally therewith.

From the foregoing description, it will be readily seen that the reclosable container of the present invention can be easily formed from the blank 10 that is simple in construction and easy to manufacture. The container provides separate compartments for photographs and negatives stored therein and serves to enclose and protect the photographs and negatives therein. The plastic material of the container will protect the photographic materials stored therein from moisture and also is acid-free to further prevent deterioration of the photographic materials.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A reclosable container for film cartridges, photographs, negatives and other articles, comprising:

a rear panel;

a pair of front flaps foldably connected to the sides of the rear panel and extending laterally inwardly over said rear panel in spaced relation thereto;

a front panel foldably connected to the bottom of said rear panel and extending upwardly over said front flaps; and a cover panel foldably connected to the top of said rear panel and extending in a closed position downwardly over said front panel;

whereby said rear panel, said front flaps and said front panel define a first compartment; and said front flaps and said front panel define between the overlapped portions thereof a second compartment in front of said first compartment; said first compartment and said second compartment having a width substantially the same as the width of said rear panel;

side panels being disposed between and foldably connected in substantially perpendicular relation to said rear panel and said front flaps, a top panel being disposed between and foldably connected in substantially perpendicular relation to said rear panel and said cover panel, and a bottom panel being disposed between and foldably connected in substantially perpendicular relation to said rear panel and said front panel, said side panels, said top panel and said bottom panel being of substantially the same width;

fold lines being disposed between said side panels and said front flaps, said fold lines having first slits therein, and said front panel having first locking tabs on the sides thereof in removable and reclosable locking engagement with said first slits;

said front panel having a second slit therein, and said cover panel having a second locking tab in removable and reclosable locking engagement with said second slit when said cover panel is in said closed position.

2. The container of claim 1 wherein said front flaps, said front panel and said cover panel are in substantially parallel relation to said rear panel when said cover panel is in said closed position.

3. The container of claim 1 wherein bottom tabs are foldably connected to the lower ends of said side panels and extend inwardly over said bottom panel.

4. The container of claim 1 wherein the upper end portion of said front panel is recessed in the mid-portion thereof to facilitate the gripping of negatives or the like in said second compartment.

5. The container of claim 1 wherein it is formed of unitary construction of a clear, flexible and resilient plastic material.

6. A flat blank for forming a reclosable container for film cartridges, photographs, negatives and other articles, comprising:

a rear panel;

a pair of front flaps foldably connected to the sides of the rear panel and adapted to be folded laterally inwardly over said rear panel in spaced relation thereto;

a front panel foldably connected to the bottom of said rear panel, and adapted to be folded upwardly over said front flaps when they are folded over said rear panel; and a cover panel foldably connected to the top of said rear panel and adapted to be folded downwardly to a closed position over said front panel when it is folded upwardly over said front flaps;

whereby said rear panel, said front flaps and said front panel are adapted to define a first compartment when folded over said rear panel; and said front flaps and said front panel are adapted to define a second compartment in front of said first compartment when said front panel and said front flaps are folded in overlapping relation over said rear panel;

said first and second compartments having a width substantially the same as the width of said rear panel;

side panels being disposed between and foldably connected to said rear panel and said front flaps, a top panel being disposed between and foldably connected to said rear panel and said cover panel, and a bottom panel being disposed between and foldably connected to said rear panel and said front panel, said side panels, said top panel, and said bottom panel being of substantially the same width;

said side panels, said bottom panel and said top panel being adapted to be folded inwardly, upwardly and downwardly, respectively, in substantially perpendicular relation to said rear panel, said front flaps being adapted to be folded laterally inwardly in substantially perpendicular relation to said side panel, said front panel being adapted to be folded upwardly into substantially perpendicular relation to said bottom panel, and said cover panel being adapted to be folded downwardly into substantially perpendicular relation to said top panel;

fold lines being disposed between said side panels and said front flaps, said fold lines having first slits therein and said front panel having first locking tabs on the sides thereof adapted for removable and reclosable locking engagement with said first slits when said front flaps and said front panel are folded inwardly over said rear panel;

said front panel having a second slit therein, and said cover panel having a second locking tab adapted for removable and reclosable locking engagement with said second slit when said front panel and said cover panel are folded over said rear panel.

7. The blank of claim 6 wherein said rear panel, said top panel, said side panels, said bottom panel, said front flaps, said front panel and said cover panel are foldably connected by fold lines.

8. The blank of claim 6 wherein bottom tabs are foldably connected to the lower ends of said side panels and are adapted to extend inwardly over said bottom panel when it is folded into substantially perpendicular relation to said rear panel.

9. The blank of claim 6 wherein the upper end portion of said front panel is recessed in the mid-portion thereof to facilitate the gripping of negatives and the like in said second compartment when said front panel is folded upwardly over said front flaps and said rear panel.

10. The blank of claim 6 wherein it is formed of unitary construction of a clear, flexible and resilient plastic material.

* * * * *